US005462269A

United States Patent [19]

Schroeder et al.

[11] Patent Number: 5,462,269

[45] Date of Patent: Oct. 31, 1995

[54] ADJUSTABLE BACKBOARD ASSEMBLY WITH DRIVE LOCK

[75] Inventors: Edward A. Schroeder, Marengo; James Gallicchio, Schiller Park, both of Ill.

[73] Assignee: Porter Athletic Equipment Company, Broadview, Ill.

[21] Appl. No.: 210,452

[22] Filed: Mar. 21, 1994

[51] Int. Cl.[6] ..... A63B 63/08

[52] U.S. Cl. ..... 273/15 R; 74/548; 254/98; 254/DIG. 2; 254/DIG. 3; 411/120

[58] Field of Search ..... 273/1.5 R, 1.5 A; 70/183–187; 254/98–103, DIG. 2, DIG. 3; 74/548, 530; 411/120, 119

[56] References Cited

U.S. PATENT DOCUMENTS

| | | | |
|---|---|---|---|
| 602,262 | 4/1898 | La France | 74/548 X |
| 887,382 | 5/1908 | Diplock | 411/120 |
| 2,916,288 | 9/1956 | Chervenka . | |
| 2,986,395 | 2/1957 | Sheftel . | |
| 3,059,289 | 10/1962 | Roland | 411/120 X |
| 3,389,735 | 6/1968 | Katz | 411/120 |
| 3,598,406 | 2/1968 | Robinson . | |
| 3,765,676 | 10/1973 | Bearson et al. . | |
| 4,395,040 | 7/1983 | White . | |
| 4,465,277 | 8/1984 | Dittrich . | |
| 4,522,394 | 6/1985 | Broussard . | |
| 4,643,422 | 2/1987 | Cramblett . | |
| 4,872,230 | 10/1989 | Levine | 254/DIG. 2 X |
| 4,941,661 | 7/1990 | Lykens . | |
| 4,943,034 | 7/1990 | Wagnon | 254/DIG. 2 X |
| 4,948,127 | 8/1990 | Willard . | |
| 5,102,127 | 4/1992 | Pohrer . | |
| 5,156,395 | 10/1992 | Smith . | |
| 5,279,496 | 1/1994 | Schroeder . | |

*Primary Examiner*—Paul E. Shapiro
*Attorney, Agent, or Firm*—Barnes & Thornburg

[57] ABSTRACT

A lock structure which automatically locks the screw drive upon deactivation of the screw drive and automatically unlocks the screw drive upon activation of the screw drive. The locking structure is responsive to the attaching and detaching of a driver such that the detaching of the driver from an input of the screw drive automatically locks the screw drive and attaching the driver to the input of the screw drive automatically unlocks the screw drive. This is achieved by providing an outer locking surface on the screw drive and a locking plate whose axial position is controlled by the position of the drive and having an aperture for mating with the outer locking surface and locking the screw drive.

8 Claims, 2 Drawing Sheets

ADJUSTABLE BACKBOARD ASSEMBLY WITH DRIVE LOCK

TECHNICAL FIELD

The present invention relates generally to adjustable backboards and rims and more specifically to direct mount, telescopic adjustable basketball backboard and rim structures.

BACKGROUND ART

In the art of adjustable backboards and rims, a typical example is the use of a parallelogram connected between a support structure and the backboard and rim combination. The height of the backboard and rim is adjustable and locked in place. Various mechanisms have been used for the drive and the locking mechanisms. These generally have fallen in the categories of screw and bolt mechanisms, and rachet mechanisms. Although the parallelogram with the rachet mechanism has been very popular in the consumer market, the institutional market has different requirements. A parallelogram takes up valuable space because of the distance required from the support structure. Similarly, institutional backboards and rims are substantially heavier than consumer backboards and rims and therefore require a more substantial structure than a cantilevered parallelogram structure. A typical example of the screw and bolt drive parallelogram structures are shown by U.S. Pat. Nos. 3,765,676 to Bearson et al. and No. 4,395,040 to White.

Another method of adjusting the height of the backboard is a linear motion between the backboard structure and support. A typical example of a screw drive is U.S. Pat. No. 5,279,496 to Schroeder and patents cited of record therein. Other examples of a linear adjustment for ground mounted backboards include adjusting the mount itself. Typical examples are U.S. Pat. No. 5,156,395 to Smith and No. 3,598,406 to Robinson. These include screw as well as gears or rack and pinion drives.

Most of the prior art including screw drives and gear drives do not have any lock of the adjustment. Thus, during play, the adjustment mechanism can creep downwardly. One example of a lock mechanism is provided in U.S. Pat. No. 4,522,394 to Broussard. The gear 216 in cooperation with the ratchet 122 adjusts the height of the pole to which the backboard and rim is attached. Ball bearings 238 rest in opposed hemisphere dimples 226 and 236 on the gear and lock plate respectfully. The application of the force from the handle 220 causes the balls to ride out and unlock the gear. It should also be noted that a substantial force on the backboard could cause the gear 216 to rotate with respect to the lock 232 and therefore inadvertently unlock the apparatus. Thus, the prior art does not provide any positive lock to the drive mechanism of an adjustable backboard.

Other examples of locks for screw drives is radial screw element 32 on one of the rails in U.S. Pat. No. 2,916,288 to Chervenka. U.S. Pat. No. 2,986,395 includes a pin 70 in an aperture of the gear hub 58 to prevent unwanted rotation or height adjustment.

DISCLOSURE OF THE INVENTION

Thus it is the object of the present invention to provide an adjustable backboard structure with a positive lock for the drive mechanism.

Another object of the present invention is to provide an improved adjustable backboard structure with a simplified and inexpensive positive lock.

An even further object of the present invention is to provide a lock structure for an adjustable backboard structure which can be retrofitted to existing screw drives.

These and other objects are achieved by providing a lock structure which automatically locks the screw drive upon deactivation of the screw drive and automatically unlocks the screw drive upon activation of the screw drive. The locking structure is responsive to the attaching and detaching of a driver such that the detaching of the driver from an input of the screw drive automatically locks the screw drive and attaching the driver to the input of the screw drive automatically unlocks the screw drive. This is achieved by providing an outer locking surface on the screw drive and a locking plate having an aperture for mating with the outer locking surface and locking the screw drive. An automatic mechanism or spring maintains the locking surface mated with the aperture when the driver is detached from the input and allows the locking surface to exit the aperture when the driver is attached to the input. Preferably, the locking surface is on the input and the driver is detachably mounted to the locking surface for maintaining the locking surface out of the aperture. The locking surface and the aperture include one or more linear segments and maybe, for example, hexagonal shape. The driver may be a handle or a motor. The automatic mechanism or spring biases the plate along the axis of the screw of a screw drive.

Although the positive locking structure has been described for a screw drive, the locking structure may be used with other drives such that the locking structure automatically locks the drive upon detaching of a driver from the input of the drive and automatically unlocks the drive upon attaching the driver to the input of the drive.

Other objects, advantages and novel features of the present invention will become apparent from the following detailed description of the invention when considered in conjunction with the accompanying drawings.

BEST MODES FOR CARRYING OUT THE INVENTION

Figure 1:
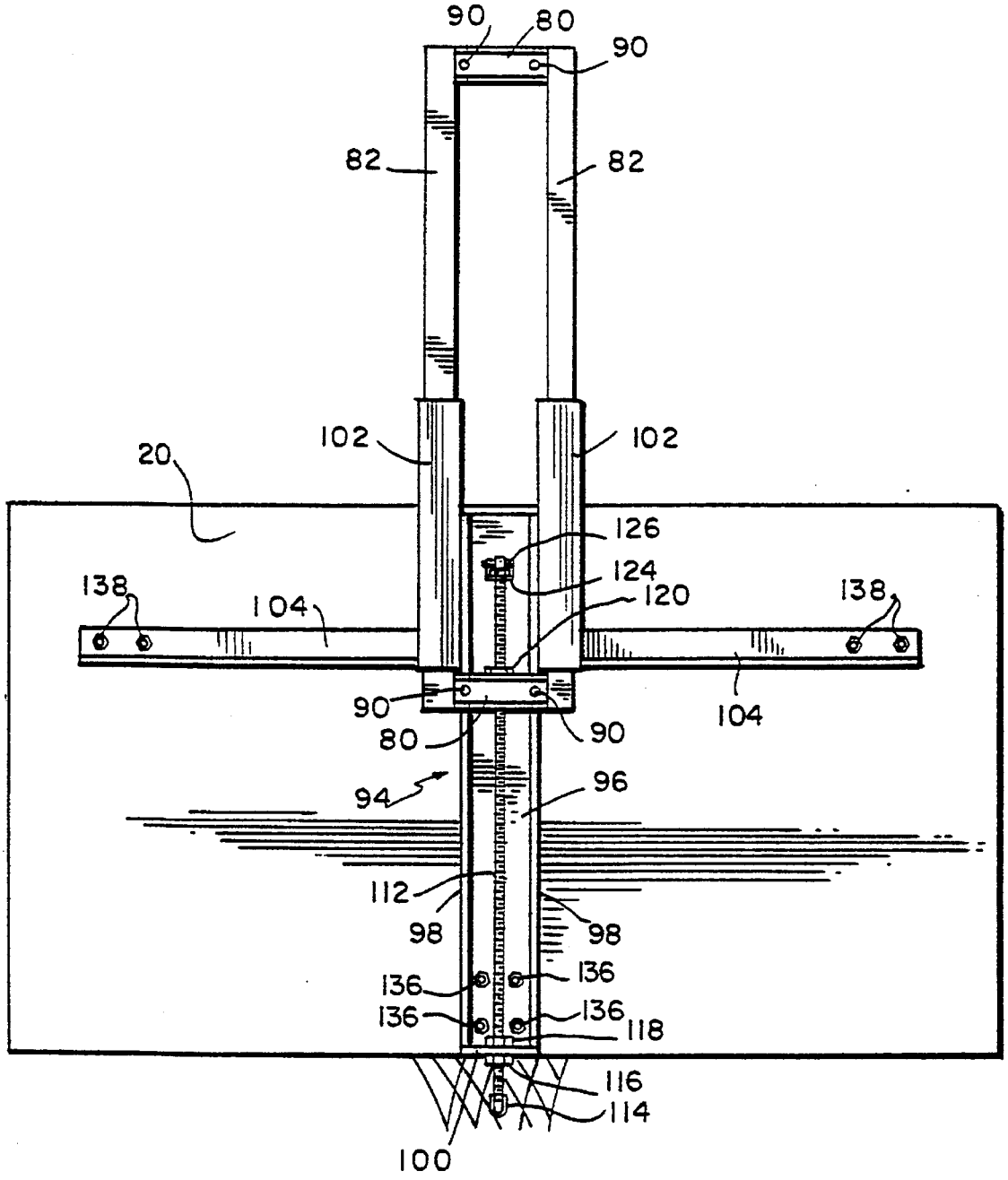
PRIOR ART FIG. 1
FIG. 1 is a back view of an adjustable backboard system of a prior art.

The prior art adjustment structure of FIG. 1 shows a backboard 20 with a rim mounted thereto. An adjustable backboard structure illustrated is that of U.S. Pat. No. 5,279,496 which is incorporated herein by reference. A pair of support brackets 80 are interconnected by a pair of guides 82, by for example welding it to the lateral faces. The vertical wall of brackets 80 include a pair of apertures 90 to receive a fastener, for example a U-bolt which would connect the support bracket 80 to a single strut.

The guide and backboard structure includes a single center bracket 94 being generally U-shaped and having a pair of opposed legs or side walls 98 connected by a rear wall 96. A bottom wall 100 is connected to the side walls 98 and the rear wall 96. A pair of slides 102 are connected adjacent to the edges of the center bracket 94. The slides 102 are telescopically received on the guides 82. A pair of lateral brackets 104 extend from the center bracket 94 and are also butt welded to the exterior of the side walls 98. Apertures provided in the lateral brackets 104 receive fasteners 13% to mount the backboard 20 to the center bracket 94 and the slides 102. The back wall 96 of the center bracket 94 includes a pair of upper apertures and elongated bottom apertures to receive the fasteners 136 of a basketball rim. This allows the connection of the rim directly to the center bracket 94 and the slides 102 through the backboard.

The drive mechanism which moves the slides 102 on the guides 82 include a screw mechanism 112 including a loop 114 to receive a crank or other hand manipulating device. The screw 112 is received in bearings 116 and 118 mounted to opposite sides of the bottom wall 100 of the center bracket 94. The screw 112 is then received in a nut 120 mounted to an L-shaped bracket which is welded to wall 86 of bottom mounting bracket 80. Finally, the end of the screw 112 is received in a bracket 124 welded to the inside of the rear wall 96 and a cotter pin 126 is received in the end of the screw 112.

As previously described, FIG. 1 is the structure described in U.S. Pat. No. 5,279,496 corresponds to FIG. 6 thereof. The numbers of that patent have been used such that further understanding of this driven adjustable mechanism can be obtained by referring to the aforementioned patent. All elements which are common to the prior art device of FIG. 1 and used in FIGS. 2 and 3 will have the same reference numbers as that of FIG. 1. The particular positive lock to be described may be used with the structure of FIG. 1 or any other drive mechanism for adjustable backboard. To avoid any confusion with the aforementioned patent, all reference number directed to the present invention will be in the 200 series.

Figure 2:
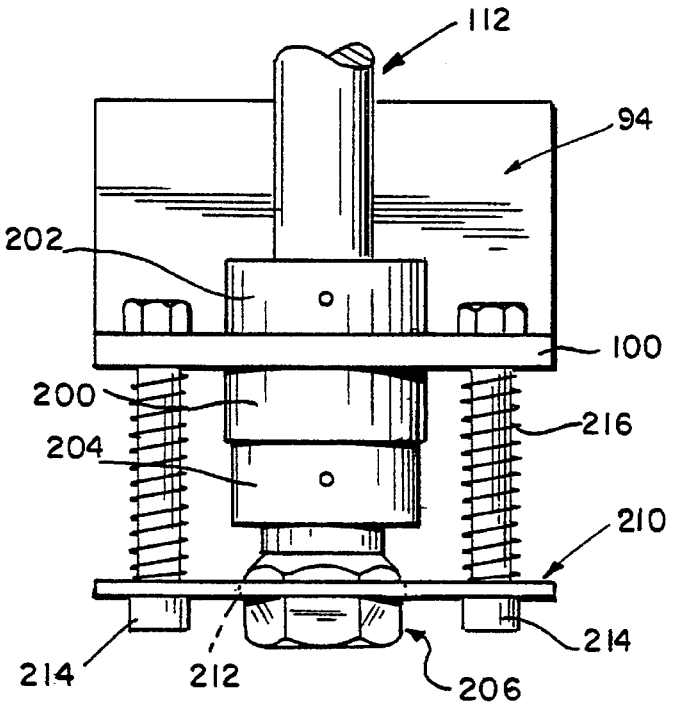
FIG. 2 is a side view of a drive lock for an adjustable backboard mounting system in its locked condition according to the principles of the present invention.
Figure 3:
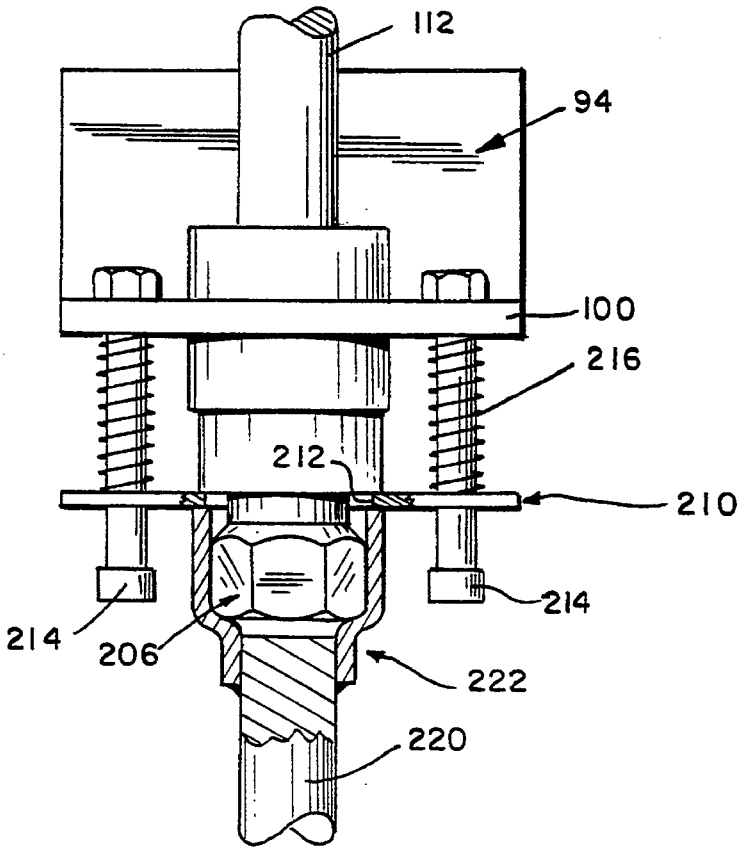
FIG. 3 is a side view of the drive lock of FIG. 2 in its unlocked condition.

As illustrated in FIGS. 2 and 3, the lower end of screw 112 is received in a thrust bearing 200 between a pair of threaded collars 202 and 204 in the bottom wall 100 of the center bracket 94. Alternatively, the bearing 116 and 118 of FIG. 1 may be used. Instead of the hook 114 on the end of screw 112, a hexagonal nut 206 is mounted thereto. As will be explained below, nut 206 is the input to the screw drive 112 and also serves as a locking surface on the screw drive to cooperate with the remainder of the lock assembly. Other elements and structure may be used to provide a locking surface which should generally include at least one linear segment or flat surface so as to provide rotational locking.

A locking plate 210 includes an aperture 212 which mates with the input locking surface or hexagonal nut 206. The aperture 2 12 has an hexagonal shape for mating with the input 206. The locking plate 210 is mounted to the lower wall 100 of the center bracket 94 by a pair of post or guides 214. A spring 216 biases the locking plate 210 into its down or locking position with respect to the drive input and locking surface 206 which is fixed in the axial direction. Thus, the springs 216 automatically maintain the locking surface on 206 mated with the aperture 212 on the locking plate 210 as illustrated in FIG. 2. A driver 220 includes a hexsocket 222 which is received on hexnut 206. The attachment of the driver 220 and its socket 222 on the mating surface 206 forces the locking plate to rise against the automatic springs 216. This decouples the mated relationship between aperture 212 on the locking plate 210 and mating surface on nut 206 and allows the drive 212 to be driven. This position or unlocked condition of the locking structure is illustrated in FIG. 3. Upon removal of the socket 222 from the input 206, the springs 216 return the locking plate 210 down onto the locking surface of the input 206.

It should be noted that if the locking surfaces on input 206 do not mate with the aperture 212 in the plate 210, any movement of the drive 112 during play may cause the locking surfaces 206 to rotate and come into alignment with the aperture 212. The automatic return springs 216 will lower the plate 210 over the locking surfaces on 206 and thereby lock it into position. Thus, the locking mechanism will prevent any further rotation of drive 112. With a hexagonal configuration of the input 206 and the aperture 212 in plate 210, less than a quarter of a turn would result before alignment and locking.

As previously discussed, hexagonal shapes is only a suggestion since hexagonal nuts 206 are very convenient and readily available. Any other shape locking surface and mating aperture can be used. It should also be noted that the locking surface may be displaced from the input 206. If such is the design, some extension must be provided on the driver so as to automatically actuate the locking structure 210 upon the attachment and detachment of the driver. The driver 220 may be a hand device or handle or may be a shaft of a motor.

The locking mechanism described is a simple structure and may be easily retrofitted on existing drives. As described with respect to FIG. 1, the hook 114 is removed and the input device 206 with the mating surface is inserted on the end of screw 112. The locking plate 210 is then mounted to move along the axis of the screw 112 in response to the attachment and detachment of a driver received on the input 206. As illustrated in FIGS. 2 and 3, all that is required is providing a pair of holes in the bottom wall 110 of the center bracket 94 and inserting post 214 with spring 210. This is one example of one type of system having a screw drive which the locking mechanism of FIGS. 2 and 3 may be used.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An adjustable backboard assembly for mounting a basketball backboard to a support comprising:

support mounting means for mounting said assembly to a support;

backboard mounting means for mounting a backboard to said assembly;

screw drive for adjusting the height of said backboard mounting means relative to said support mounting means;

an input on said screw drive for receiving a driver for operation of said screw drive;

an outer locking surface on said screw drive;

a locking plate having an aperture for mating with said outer locking surface and locking said screw drive;

a pair of guides passing through said locking plate for guiding the locking plate to move along the axis of the screw drive; and automatic means for maintaining said locking surface mated in said aperture when said driver is detached from said input and for allowing said locking surface to exit said aperture when said driver is attached to said input.

2. An assembly according to claim 1, wherein said locking surface is on said input and said driver is detachably mounted to said locking surface for maintaining said locking surface out of said aperture.

3. An assembly according to claim 1, wherein said locking surface and said aperture each include one or more linear segments.

4. An assembly according to claim 3, wherein said locking surface and said aperture each are hexagonal shaped.

5. An assembly according to claim 1, wherein said driver is a handle.

6. An assembly according to claim 1, wherein said driver is a motor.

7. An assembly according to claim 1, wherein said automatic means mounts said plate to move along an axis of a screw of said screw drive.

8. An assembly according to claim 1, wherein said automatic means includes at least one spring for biasing said plate to mate said aperture with said locking surface.

* * * * *